US009260832B2

(12) United States Patent
Subitoni et al.

(10) Patent No.: US 9,260,832 B2
(45) Date of Patent: Feb. 16, 2016

(54) FOUNDATION EQUIPMENT FOR A POLE IN PARTICULAR FOR A LIGHTING POLE

(71) Applicant: ATLANTECH S.R.L., Sorga' (IT)

(72) Inventors: Pier Luigi Subitoni, Sorga' (IT); Maikol Furlani, Sorga' (IT); Mirko Meneghelli, Sorga' (IT); Martino Boscagin, Sorga' (IT)

(73) Assignee: Atlantech S.R.L., Sorga (IT)

( * ) Notice: Subject to any disclaimer, the term of this patent is extended or adjusted under 35 U.S.C. 154(b) by 0 days.

(21) Appl. No.: 14/370,483

(22) PCT Filed: Jan. 4, 2013

(86) PCT No.: PCT/IB2013/050103
§ 371 (c)(1),
(2) Date: Jul. 2, 2014

(87) PCT Pub. No.: WO2013/102889
PCT Pub. Date: Jul. 11, 2013

(65) Prior Publication Data

US 2014/0363238 A1 Dec. 11, 2014

(30) Foreign Application Priority Data

Jan. 5, 2012 (IT) ..... VR20120001 U
Jan. 5, 2012 (IT) ..... VR20120002 U

(51) Int. Cl.
*E02D 5/56* (2006.01)
*E02D 7/22* (2006.01)

(52) U.S. Cl.
CPC ... *E02D 5/56* (2013.01); *E02D 7/22* (2013.01)

(58) Field of Classification Search
CPC ..... E02D 5/56; E02D 7/22
See application file for complete search history.

(56) References Cited

U.S. PATENT DOCUMENTS

| | | | | |
|---|---|---|---|---|
| 3,668,877 | A * | 6/1972 | Fuentes, Jr. | 405/232 |
| 3,698,144 | A * | 10/1972 | Stratton | 52/99 |
| 4,621,950 | A * | 11/1986 | Kinnan | 405/231 |
| 6,872,883 | B2 * | 3/2005 | Ginsburg | 174/45 R |
| 6,893,598 | B1 * | 5/2005 | March | 264/267 |
| 2002/0007613 | A1 * | 1/2002 | Gordin et al. | 52/726.4 |
| 2004/0221543 | A1 * | 11/2004 | Eleas et al. | 52/736.1 |
| 2005/0120813 | A1 | 6/2005 | Clark et al. | |
| 2008/0019779 | A1 * | 1/2008 | Henderson | 405/237 |
| 2012/0328374 | A1 * | 12/2012 | El Naggar et al. | 405/233 |

FOREIGN PATENT DOCUMENTS

EP 0 542 692 A1 5/1993

OTHER PUBLICATIONS

PCT Notification of Transmittal of the International Search Report and the Written Opinion of the International Searching Authority, or the Declaration for PCT Counterpart Application No. PCT/IB2013/050103, 8 pgs., (Mar. 4, 2014).

* cited by examiner

*Primary Examiner* — Benjamin Fiorello
(74) *Attorney, Agent, or Firm* — Blakely, Sokoloff, Taylor & Zafman LLP

(57) ABSTRACT

Foundation equipment for a pole, in particular, or a lighting pole.
The equipment includes
at least one screw element adapted to be screwed into the ground; and
at least one box-like body, mechanically fixed to the screw element.
The box-like body is divided into two compartments by a partition wall. One compartment is adapted to receive the lower end of the pole.

9 Claims, 8 Drawing Sheets

FOUNDATION EQUIPMENT FOR A POLE IN PARTICULAR FOR A LIGHTING POLE

CROSS-REFERENCE TO RELATED APPLICATIONS

This patent application is a U.S. National Phase Application under 35 U.S.C. §371 of International Application No. PCT/IB2013/050103, filed Jan. 4, 2013, entitled FOUNDATION EQUIPMENT FOR A POLE IN PARTICULAR FOR A LIGHTING POLE, which claims priority to Italian Patent Application No. VR2012U000001, filed Jan. 5, 2012, and Italian Patent Application No. VR2012U000002, filed Jan. 5, 2012.

FIELD

The present invention relates to a foundation, equipment for a pole, in particular, for a lighting pole.

In fact, in particular, the present invention finds advantageous, but not exclusive application in the installation of lighting poles, to which the following description will make explicit reference without thereby losing generality.

BACKGROUND

As known, currently in the technical field of lighting pole installation normally is provided the use:

- of a concrete foundation, prefabricated or executed on site, provided with a hole wherein the lighting pole is inserted, and
- of an installation manhole where the electrical line cables arrive, and wherein the exit terminal boards of the power supply electric wires of the lamp installed, on the pole are housed.

However, current techniques for the installation of poles require high costs and extensive time expenditure and the use of skilled labor. In addition, the existing concrete structures are invasive structures not usable in areas subject to specific environmental constraints.

SUMMARY

Therefore, object of the present invention is to provide a foundation equipment for poles, free from the drawbacks described above and, at the same time, easy and inexpensive to manufacture.

According to the present invention, therefore, the foundation equipment for a pole as claimed in claim 1 or in any of the dependent claims, directly or indirectly, on claim 1 is obtained.

BRIEF DESCRIPTION OF THE DRAWINGS

For a better understanding of the present invention, some preferred embodiments are now described (indifferent scales), purely by way of non-limiting examples and with reference to the accompanying drawings, wherein.

DETAILED DESCRIPTION

Figures 1A, 1B:
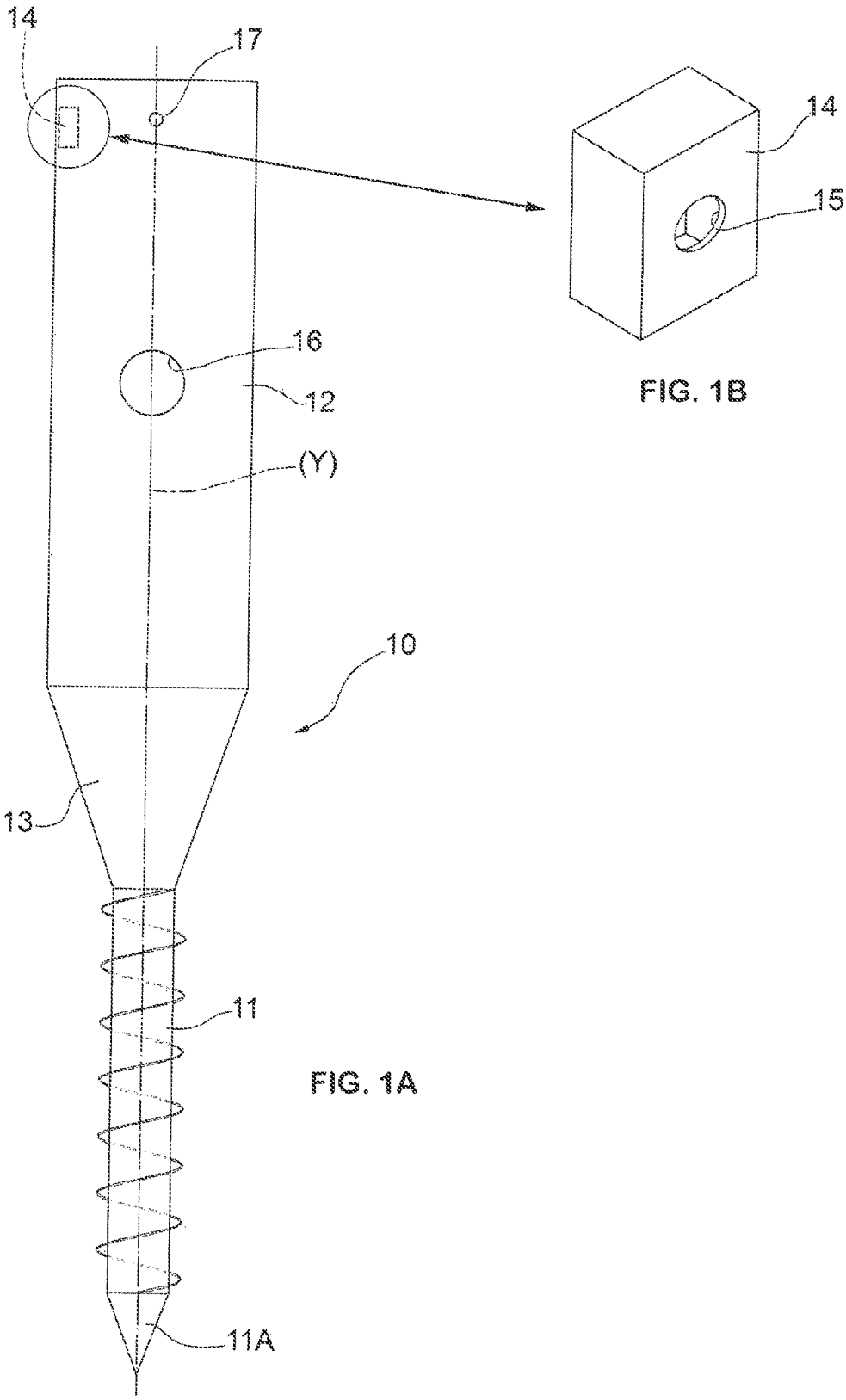
FIG. 1A shows a first possible application of the teachings of the present invention to a foundation equipment.
FIG. 1B shows an embodiment of a nut with a threaded hole.

In FIG. 1A, with 10 has been indicated, as a whole, a first possible application of the teachings of the present invention to a foundation equipment.

Equipment 10, of vertical axis with longitudinal symmetry (Y), comprises a lower treaded shank 11, provided with a tip 11A at one end thereof, adapted to be screwed into the ground.

Equipment 10 also comprises an upper, box-like body 12 mechanically fixed to the above said lower threaded shank 11. In the present case, the lower threaded shank 11 is connected to the upper box-like body 12 by way of an intermediate conical connection 13.

The three elements 11, 12, 13 may be formed separately one from the other and then welded together so as to form a single body, or they can be made in one piece.

In the configuration shown in FIGS. 1A and 1B, the box-like body 12 assumes the appearance of a hollow cylindrical body on the wall thereof a nut 14 for the grounding of the lighting pole (not shown) is fixed; said nut 14 is provided with a threaded hole 15 for the purposes that will be better clarified below.

As illustrated again in FIG. 1A, in the box-like body 12, at different heights, a first through hole 16 for the passage of at least an electric cable (not shown) and a second through hole 17 are provided, which, as will be better seen later, allows to fix a manhole 20 shown in FIG. 2.

In the present case, the manhole 20 has the shape of a rectangular parallelepiped provided with a flat bottom 21 on which four rectangular walls 22, 23, 24, 25 perpendicular thereto rise.

In particular, the flat bottom 21 and the wall 22 are devoid of an opening, while on each wall 23, 24 a respective through opening 23A, 24A is provided. In particular the through openings 23A, 24A have the same diameter and are placed at the same height with respect to the flat bottom 21.

In addition, on the wall 25 a through opening 26 of diameter equal to that of the first through hole 16 made on the wall of the box-like body 12 is provided.

Also on the wall 25, in a raised position with respect to that of the through opening 26, there is a through, hole 27, which, in use corresponds to said second through hole 17 (FIG. 1A).

Figure 3:
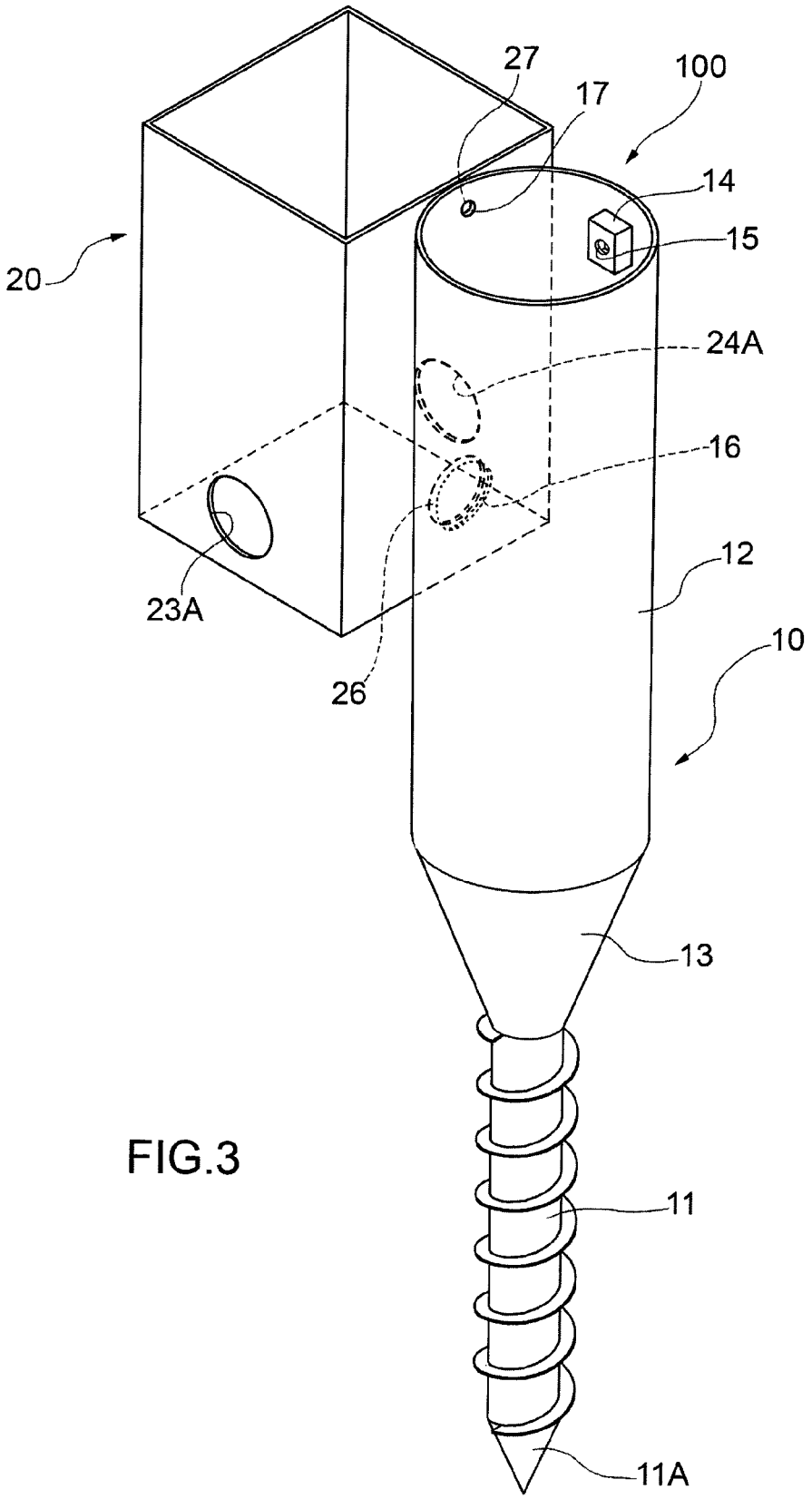
FIG. 3 shows a foundation system comprised by the set of equipment according to FIGS. 1A and 1B with the manhole shown in FIG. 2.

When the equipment 10 and the manhole 20 are assembled to one another they assume the appearance shown in FIG. 3, and give rise to a foundation plant 100.

As can be inferred from the observation of FIG. 3, the through hole 17 faces the through hole 27 and both are crossed by reversible fixing means of a known and not illustrated type (for example a bolt provided with a nut) that allow fixing the manhole 20 to the equipment 10.

In this way also the openings 26 and 16 are positioned facing each other so as to allow the passage of electrical power cables (see below) deriving from the power line.

Equipment 10 is positioned with a special machine (not shown) of a known type, which is anchored to-the upper part of the box-like body 12 by gripping onto the internal nut 14 of the, grounding.

During the positioning operation, the equipment 10 (FIG. 1A) is screwed into the ground until the edge of the box-like body 12 reaches the predetermined final level, or, at most, when it reaches the ground level itself.

The lighting pole (not shown) is then lowered into the box-like body 12, so that its lower end is housed in the intermediate conical connection 13.

Thanks to the funnel-shaped surface of the intermediate conical connection 13 an installer can center the lighting pole after which he can block the respective lighting pole with respect to the equipment 10 by filling with a suitable. material the space left free between the inner wall of the box-like body 12 and the cylindrical outer surface of the lighting pole itself. Obviously, in order to have a perfect perpendicularity of the lighting pole, with respect to the ground, the installer may use a bubble level, or a similar device.

The filler material may be, an aggregate material, such as sand or gravel.

Even in the case where the equipment 10 has been screwed into the ground with its vertical axis of longitudinal symmetry (Y) not perfectly perpendicular to the ground itself, the axis of the lighting pole will always result at 90° with respect to the ground itself, thanks to the use of the bubble level by the installer.

The through openings 23A, 24A and 26, 16 allow the passage of the power cables (not shown) of the lamp carried by the lighting pole.

The use of a copper wire (not shown), which electrically connects the metal surface of the pole to the nut 14, is also provided.

More in detail we can say that the free end of the copper wire is provided with a threaded element (not shown) screwed into said threaded hole 15.

In this case, the lower threaded shank 11, being physically attached to the box-like body 12 acts as an actual "grounding" pole for the system.

Consequently, the manhole 20, as it is fixed to equipment 10, also benefits of the "grounding" by way of the threaded shank 11.

Ultimately is the entire foundation plant 100 to be grounded.

The manhole 20 may be advantageously made of galvanized steel, while for building the equipment 10 any steel can be used which is corrosion resistant and easily weldable in case of production from several pieces.

In another embodiment not shown, the box-like body has a plurality of through holes from which, for example in case of use of hardening resins as filling material, the resins themselves during casting protrude thereby improving the grip on the ground that surrounds the box-like body itself.

In use, said through holes can be traversed by ground-clinging roots. In other words within the aggregates that are present in use, in the box-like body seeds of special plants can be put, whose roots, protruding from said through holes, will cling to the surrounding ground thus increasing the stability of equipment 100, and, therefore, ultimately of the lighting pole.

This latter solution is advantageously applied to the poles that are fitted into unstable grounds, such as wetlands, or the shores of ponds or fresh water streams.

Figure 2:
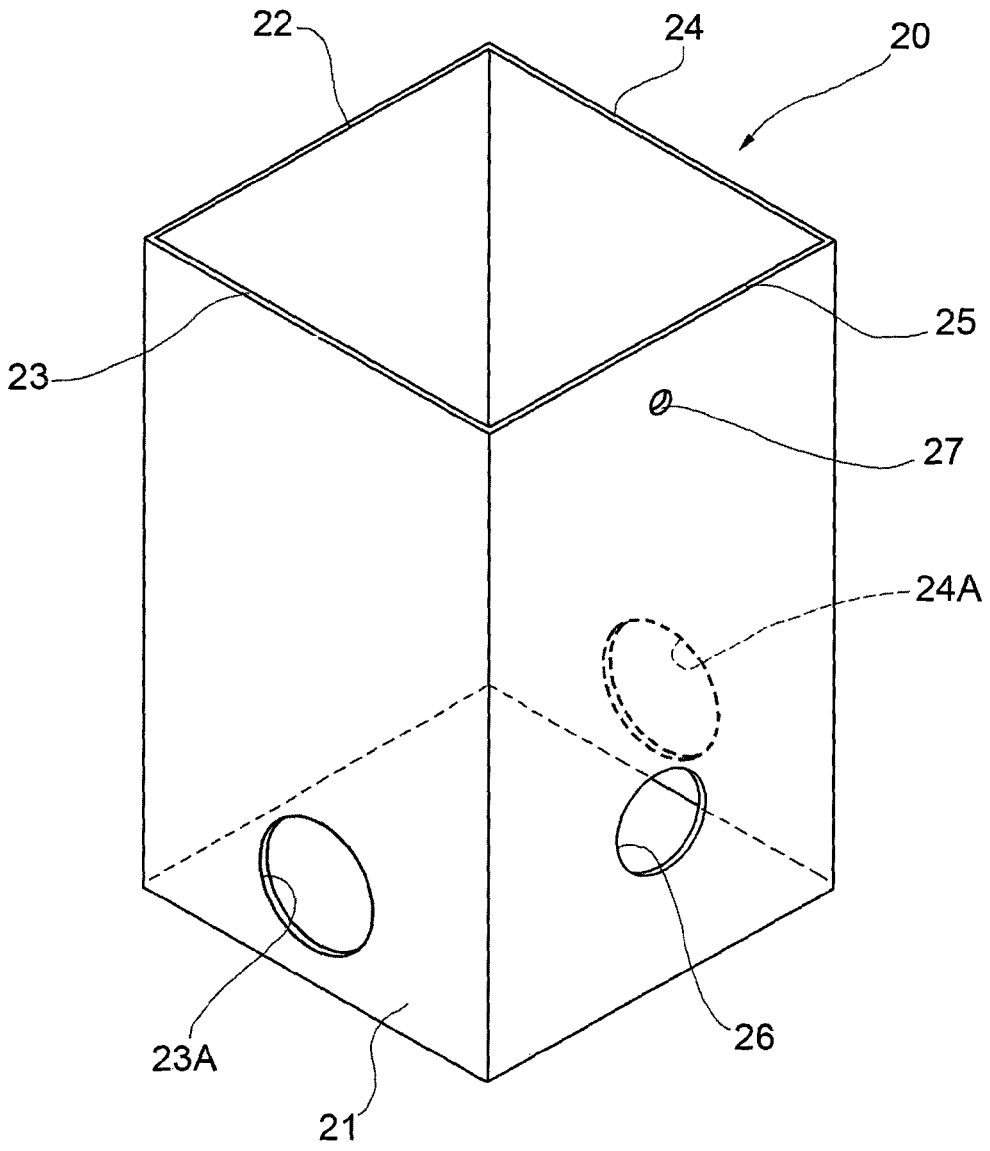
FIG. 2 shows one manhole adapted to be associated to the equipment of FIG. 1A.
Figure 4:
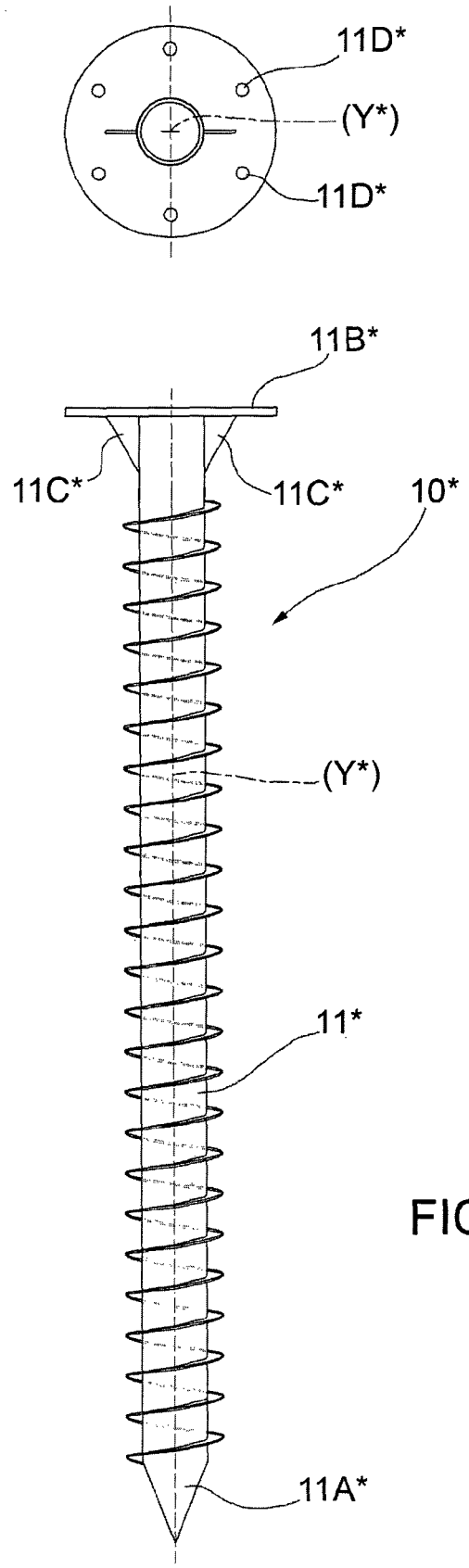
FIGS. 4 and 5 show a second possible application of the teachings of the present invention to a foundation equipment.
Figure 5:
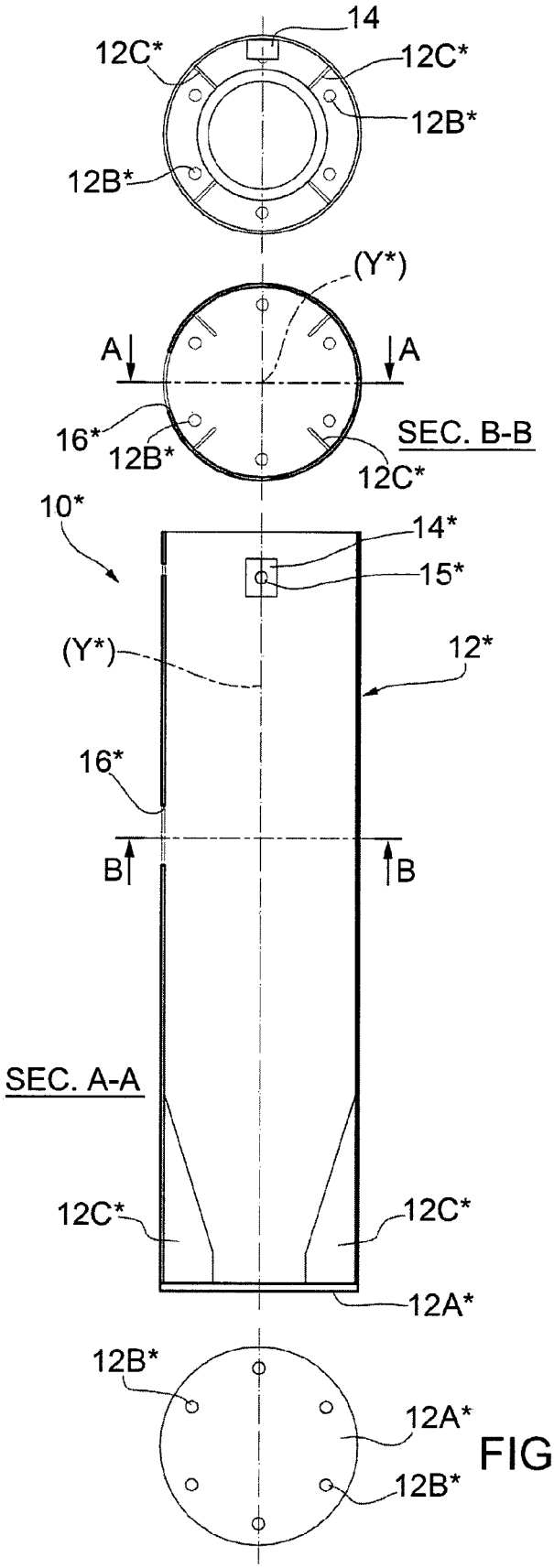
Figure 6:
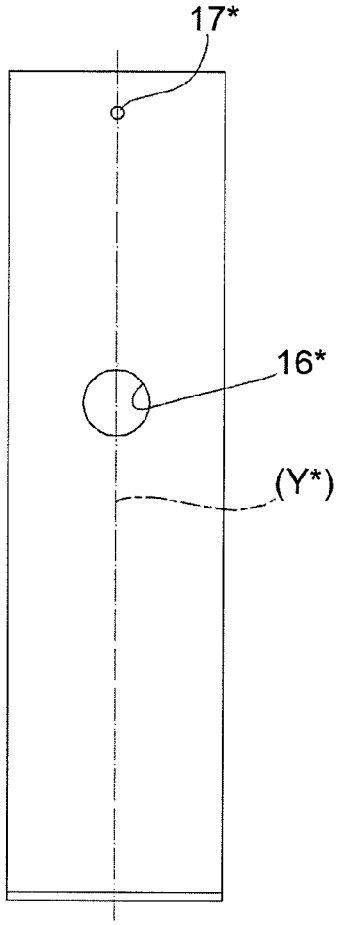
FIG. 6 shows a front view of a detail of the configuration of FIGS. 4, 5.

According to another application illustrated in FIGS. 4-6, wherein corresponding elements are indicated with the same numbers (but asterisked) of FIGS. 1-3, the equipment 10* (FIG. 4) comprises a lower threaded shank 11*, provided with a tip 11A* at one end thereof, adapted to be screwed into the ground.

The equipment 10* also comprises an upper box-like body 12* (FIGS. 5, 6) detached from said lower threaded shank 11*, but which, as we shall see, can be mounted onto the threaded shank 11* itself.

For this purpose, on the threaded shank 11*, at the free end opposite to the tip 11A*, is provided a flange 11B* perpendicular to a vertical axis of longitudinal symmetry (Y*).

A pair of anti-flex ribs 11C* connect the lower surface of the flange 11B* to the threaded shank 11*. Said flange 11B* is provided with a plurality of through holes 11D* (in this case six in number) placed on an imaginary circle and are pitch-spaced to one another.

The box-like body 12* was instead shown in more detail in FIGS. 5, 6.

It is, also in this case, a substantially cylindrical body, which, when in the mounted state with the threaded shank 11* has the same vertical axis of longitudinal symmetry (Y*). The lower end of the cylindrical body is closed by a flat bottom 12A* which is also perpendicular to the axis (Y*). Said flat bottom 12A* is provided, also, with a plurality of through holes 12B* (also in this case six in number) placed on an imaginary circle and are pitch-spaced to one another.

In use, the flat bottom 12A* of the box-like body 12* is supported on the flange 11B* of the threaded shank 11* and is fixed thereto by way of six bolts (provided with as many nuts) (not shown) each of which passes through a pair of through holes 12B*, 11D* facing each other. In this way the box-like body 12* is secured to the respective threaded shank 11* with the purpose of constituting the equipment 10*.

In the box-like body 12* are provided essentially the same elements seen for the configuration shown in FIGS. 1-3.

In particular, there will be:

- a nut 14* for the grounding of the lighting pole (not shown); said nut 14* is provided with a threaded hole 15*;
- a first through hole 16 * for the passage of at least one electrical cable (not shown); and
- a second through hole 17* to possibly fix a manhole of the type seen for the first embodiment of FIGS. 1-3.

In this particular embodiment, inside the box-like body 12* there are four alignment ribs 12C* of the lighting pole (not shown). The four ribs 12C* are funnel tapering proceeding towards the flat bottom 12A*.

In other words, in the second application the intermediate conical connection 13 seen for the first application shown in FIGS. 1-3 is replaced by all of the four alignment ribs 12C*.

It is to specify that normally the assembly of the box-like body 12* to the respective threaded shank 11* occurs before the operation of screwing the entire equipment 10* to the ground.

Regarding, instead, the fixing of the lighting pole to the equipment 10* and the grounding of the system all considerations are to be considered equal in relation, to the first embodiment illustrated with the aid of FIGS. 1-3.

Figure 7:
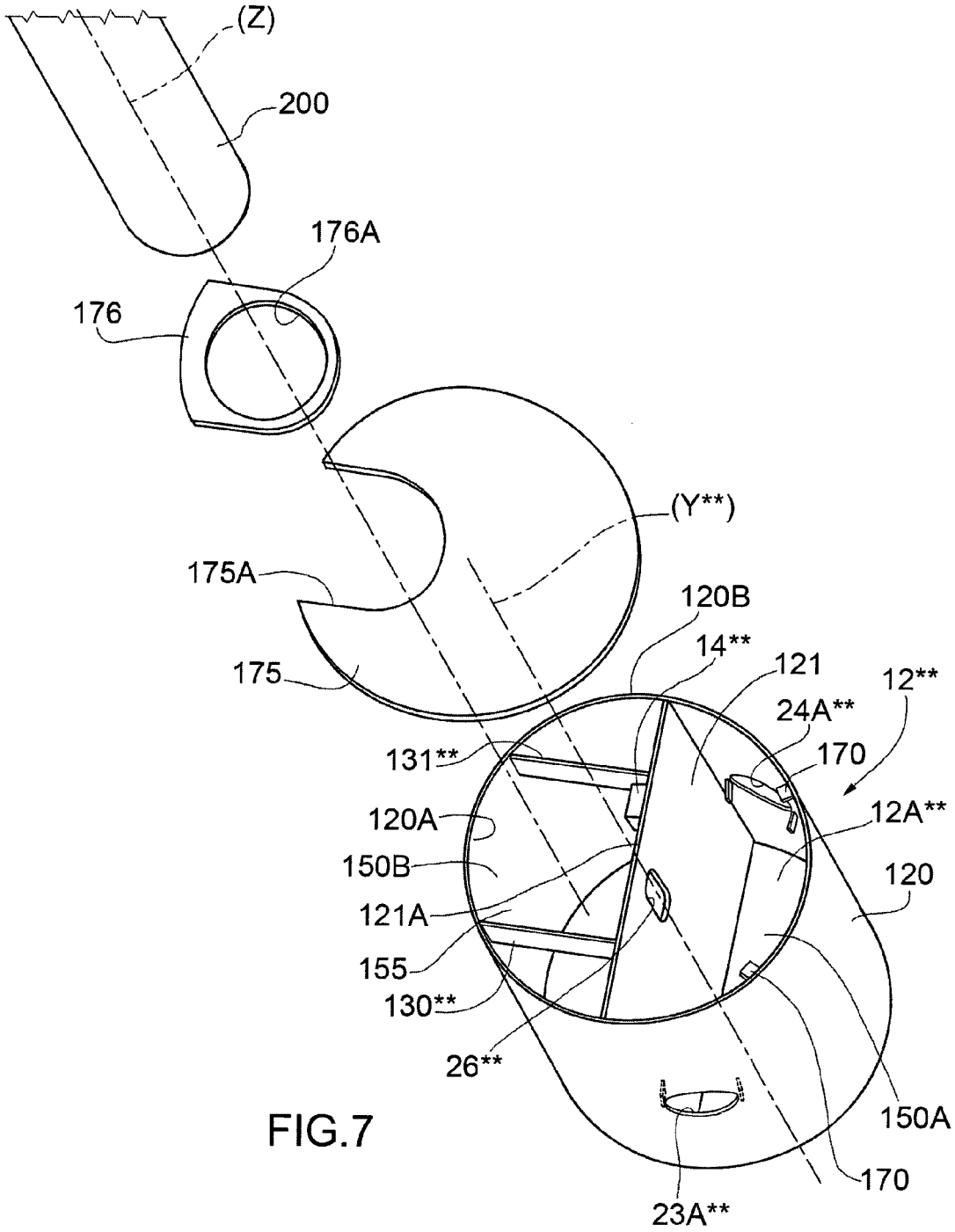
FIG. 7 shows an exploded view of a box-like body usable, in an inventive way, in the various versions of equipment shown in the preceding figures.

A further configuration of the box-like body 12 has been illustrated in FIG. 7**.

Figure 8:
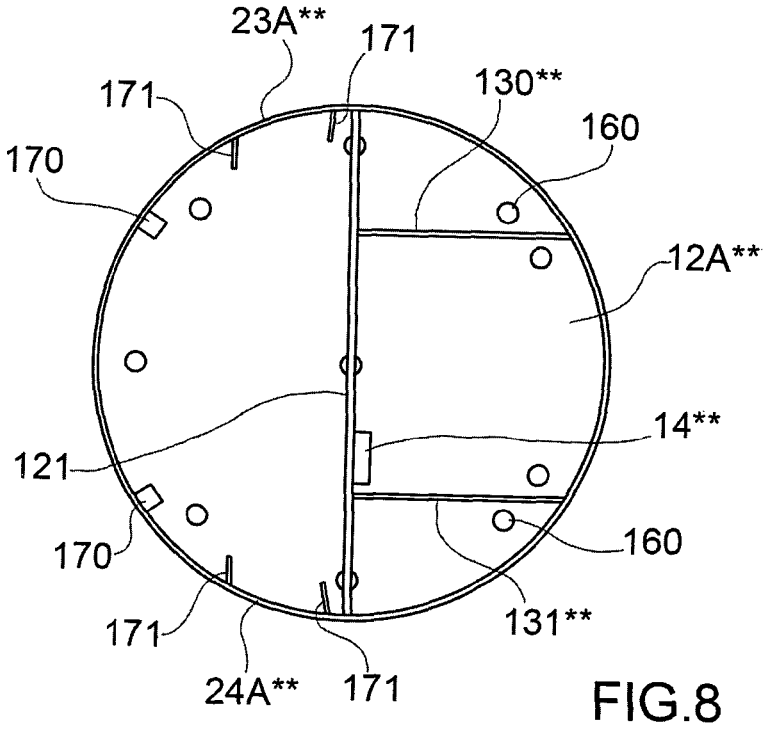
FIG. 8 shows a plan view of the box-like body of FIG. 7.

It is always a cylindrical main body 120 substantially cylindrical with a flat bottom 12A having a plurality of holes 160 for rainwater drainage (FIG. 8**).

The cylindrical main body 120 is provided with, in addition, at least a separation wall 121, which in this case is placed in a diametral position so as to separate into two equal compartments 150A, and 150B the cylindrical space 150 inside the cylindrical main body 120 itself.

In the embodiment of FIG. 7 the height of the separation wall 121 is equal to that of the cylindrical main body 120, but it is obvious that sometimes, for particular uses, said height may be less than that of the cylindrical main body 120 itself.

It is also obvious to one of the art that said separation wall 121, depending on the constructional requirements of the equipment, can be placed in any position so as to have two compartments 150A, 150B of unequal width.

Incidentally, said box-like body 12 can be produced in one piece with a threaded shank (as in the first embodiment shown in FIG. 1A), or welded thereto (always, the first embodiment of FIG. 1A), or it can be mounted onto the threaded shank using the same system adopted for the second embodiment illustrated in FIGS. 4-6**.

Upon observing the configuration of the box-like body 12 from another point of view, it can be said that the manhole and the box-like body in a strict sense are now integrated in a single cylindrical main body 120, in whose inside can be distinguished a first compartment 150A used as a manhole, and a second compartment 150B conceived so as to accommodate the lower end of the lighting pole. In other words, in the embodiment of FIG. 7, the second compartment 150B performs the functions of a box-like body in a strict sense as defined in the previous embodiments illustrated in FIGS. 1-5**.

As shown again in FIG. 7, the wall of the first compartment 150A is crossed by through openings 23A and 24A, which have the same function seen for the through openings 23A, 24A of the first embodiment. In particular the through openings 23A, 24A have the same diameter and are placed at the same height with respect to the base, and are symmetrical with respect to the separation wall 121., As in the other case, said through-openings 23A, 24A allow the insertion of the electrical power cables coming from the line (not shown). The first compartment 150A is also adapt to contain the electrical terminal boards. For this purpose, the walls of the first compartment 150A are advantageously covered by a layer (not shown) of waterproofing material that prevents, as far as possible, the entrance of moisture and/or rain water inside the first compartment 150A itself. All this with the aim of protecting the cables and terminal boards in the first compartment 150A.

Again with reference to FIG. 7, it can be noted that on the separation wall 121 also a through opening 26 was made, in the form of a slot used for the passage of electric wires for the power supply of a lamp (not shown) located on the electric pole. In other words, the through opening 26** performs the same function as the through openings 26 and 16, facing each other, considered in the embodiment illustrated in FIGS. 1-3**.

In this case the grounding nut 14 is attached to the wall of the separation wall 121 which faces towards the second compartment 150B. To said nut 14** can be fixed, as usual, a copper wire (not shown) electrically connected with the metal surface of the lighting pole.

Advantageously, the second compartment 150B can be provided with two bulkheads 130, 131** parallel to each other and perpendicular to the separation wall 121**.

Even the two bulkheads 130, 131** may have different heights but at most equal to that of the cylindrical, main body 120**.

The two bulkheads 130, 131**, the central part 121A of the separation wall 121, and a portion 120A of the cylindrical main body 120 define a seat 155 wherein the installer will insert, in use, the lower end of the lighting pole. At this point the installer pours the sand or gravel in the space of the seat 155** not occupied by the pole. For the vertical adjustment of the pole, the installer can advantageously use the systems mentioned above.

Figure 9:
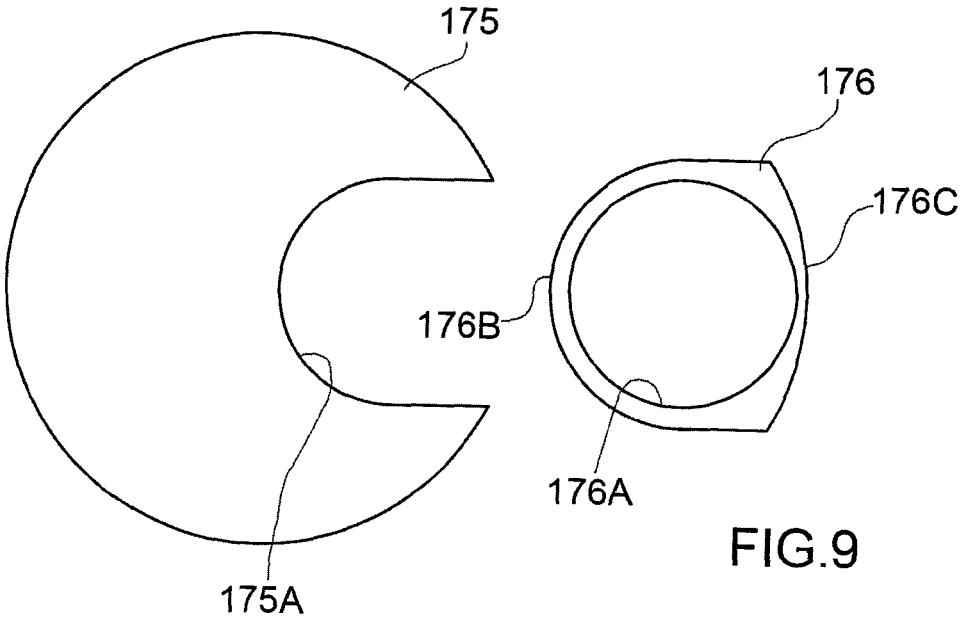
FIG. 9 shows some details of the exploded view of FIG. 7.

One of the advantages of adopting the system shown in FIGS. 7-9 consists in the fact that the central vertical axis of symmetry (Y) does not coincide with the central vertical axis of symmetry (Z) of a pole 200.

In other words, in the embodiment shown in FIGS. 7-9, in use, the axis of the pole is offset with respect to that of the box-like body 12 to allow the approach of the pole 200** to a predetermined line, for example a fence or the edge of a sidewalk (not shown).

The upper edge 120B of the main body 120 is provided with a plurality of projecting tabs 170 on which, in use, a lid 175 provided with a slot 175A is placed.

Furthermore, the slot 175A is shaped so as to receive a cap 176 provided with a central through hole 176A whose diameter is substantially equal to that of the pole 200.

As shown in more detail in FIG. 9, the outer contour of the cap 176 is shaped so as to follow for a first section 176B the contour of the slot 175A, and for a second section 176C the outer contour of the lid 175.

As shown in FIG. 8, each through opening 23A, respectively, 24A may be accompanied by a respective pair of wings 171 bent and converging, and which serve as a. guide for a respective electric cable (not shown) inserted in one of the two through openings 23A, 24A themselves.

The box-like body 12 can be produced in one piece (or welded) with the screw element 11 (FIG. 1A), or it can be mounted in a reversible manner on the screw element 11* itself (FIG. 4**).

Figure 10:
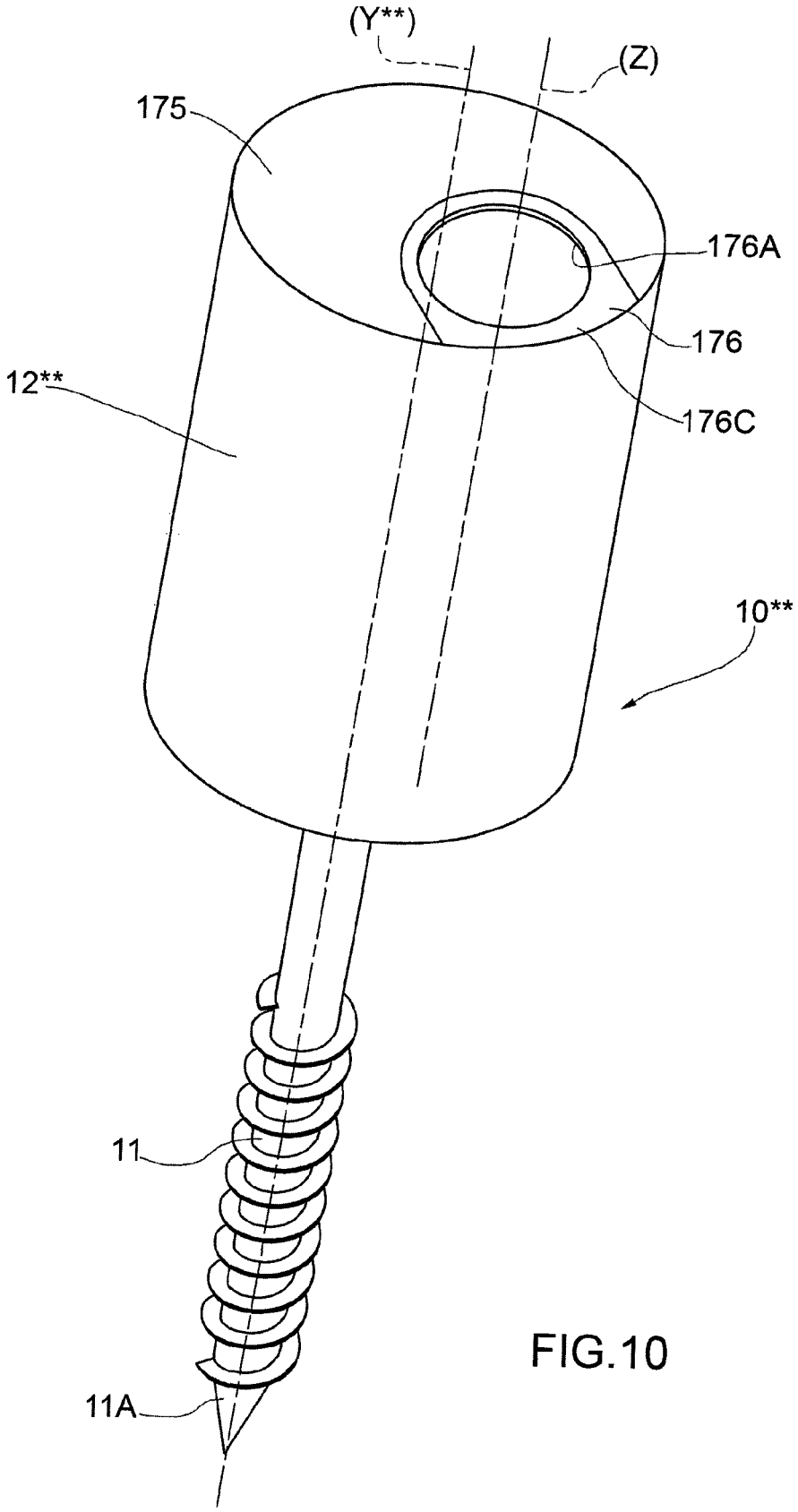
FIG. 10 shows a possible embodiment of the present invention.

A possible embodiment of the present invention has been shown in FIG. 10, where the box-like body 12 has been combined with a lower threaded shank 11 of the type shown in FIGS. 1A, 3 so as to constitute a foundation equipment 10****.

In an embodiment not illustrated of a further foundation equipment, the box-like body 12 is instead coupled to a lower threaded shank 11* of the type shown in FIG. 4**.

One skilled in the art easily recognizes that, even if the box-like body has been always represented and described as cylindrical, it may take any shape, in particular that of a rectangular parallelepiped.

The main advantages of the foundation equipment for poles object of the present invention can be summarized as follows:

- the threaded shank requires brief installation time and a use of qualitatively less arduous labor, since the steps of the whole installation cycle, from transport to installation, do not envisage loads to be handled by hand over 20 kg and the insertion into the ground is completely carried out by machine;
- the work of the installer is limited for the most part in controlling the installation accuracy eliminating all the risks associated with construction work carried out by big machinery;
- the equipment is not invasive but simple and silent and its use is allowed, even in areas subject to environmental, artistic constraints, or of any other type because it is easily removable by unscrewing from the ground; and
- the equipment is suitable for being used in any type of ground and therefore also in harsh environments, such as slopes, soft roadsides, landfill, wetlands, beaches, shorefronts, etc.

What is claimed is:

1. Foundation equipment for a lighting pole, wherein the equipment comprises:

at least one screw element adapted to be screwed into the ground; and at least one box-like body mechanically fixed to said screw element, said box-like body being divided into at least two compartments by at least one partition wall, at least one compartment being adapted to receive the lower end of said lighting pole, and wherein upon said partition wall there is a through opening adapted to connect said at least two compartments.

2. The equipment, as claimed in claim 1, wherein said screw element and said box-like body are produced as one piece.

3. The equipment, as claimed in claim 1, wherein said screw element and said box-like body are fixable to one another using a reversible fixing means.

4. The equipment, as claimed in claim 3, wherein said reversible fixing means comprise two series of through holes, a plurality of bolts and a plurality of nuts.

5. The equipment, as claimed in claim 1, wherein a second compartment is provided with two bulkheads parallel to each other and perpendicular to said partition wall.

6. The equipment, as claimed in claim 5, wherein said two bulkheads, a central part of said partition wall, and a portion of said cylindrical main body define a seat adapted to house the lower end of said lighting pole.

7. The equipment, as claimed in claim 6, wherein any wall of said seat is provided with at least one grounding element of said lighting pole.

8. The equipment, as claimed in claim 1, comprising a lid provided with a respective slot; said slot being shaped so as to accommodate a cap provided with a central through hole whose diameter is substantially equal to that of said lighting pole.

9. The equipment, as claimed in claim 8, wherein the outer contour of said cap is shaped so as to follow for a first section the contour of said slot, and for a second section the outer contour of said lid.

* * * * *